US009745803B2

(12) United States Patent
Buytaert et al.

(10) Patent No.: US 9,745,803 B2
(45) Date of Patent: Aug. 29, 2017

(54) CENTRALIZER ASSEMBLY AND METHOD FOR ATTACHING TO A TUBULAR

(71) Applicant: ANTELOPE OIL TOOL & MFG. CO., LLC, Mineral Wells, TX (US)

(72) Inventors: Jean Buytaert, Mineral Wells, TX (US); Ira Eugene Hining, Mineral Wells, TX (US); Eugene Edward Miller, Weatherford, TX (US); David E. Y. Levie, Kastanienbaum (CH); Richard Ronald Baynham, Marina di Ravenna (IT)

(73) Assignee: ANTELOPE OIL TOOL & MFG. CO., Houston, TX (US)

( * ) Notice: Subject to any disclaimer, the term of this patent is extended or adjusted under 35 U.S.C. 154(b) by 119 days.

(21) Appl. No.: 14/502,799

(22) Filed: Sep. 30, 2014

(65) Prior Publication Data

US 2015/0021047 A1 Jan. 22, 2015

Related U.S. Application Data

(60) Continuation-in-part of application No. 13/191,074, filed on Jul. 26, 2011, now Pat. No. 8,851,168, and a (Continued)

(51) Int. Cl.
*E21B 17/10* (2006.01)

(52) U.S. Cl.
CPC ..... *E21B 17/1078* (2013.01); *E21B 17/1028* (2013.01)

(58) Field of Classification Search
CPC .. E21B 17/1078; E21B 17/1028; E21B 17/10; E21B 17/1014; E21B 17/1021; E21B 17/105
See application file for complete search history.

(56) References Cited

U.S. PATENT DOCUMENTS 1,201,706 A 10/1916 Dodge
2,368,401 A 1/1945 Baker
(Continued)

FOREIGN PATENT DOCUMENTS

EP 0088507 A1 9/1983
EP 0701041 A2 3/1996
(Continued)

OTHER PUBLICATIONS

Non-Final Office Action dated Sep. 13, 2012, U.S. Appl. No. 12/756,177, filed Apr. 8, 2010, pp. 1-24.
(Continued)

*Primary Examiner* — Brad Harcourt
(74) *Attorney, Agent, or Firm* — MH2 Technology Law Group, LLP

(57) ABSTRACT

A centralizer, method, and centralizer assembly. For example, the centralizer assembly includes a first stop collar fixed in place on a tubular, and a first end collar that is sized to slide axially over the first stop collar. The centralizer assembly also includes a first retainer coupled with the first end collar. The first retainer prevents the first stop collar from sliding past the first stop collar in at least one axial direction. The assembly also includes a plurality of ribs coupled with the first end collar and configured to engage a surrounding tubular in which the tubular is disposed.

19 Claims, 8 Drawing Sheets

Related U.S. Application Data continuation-in-part of application No. 14/046,320, filed on Oct. 4, 2013, now Pat. No. 9,273,525, which is a division of application No. 12/756,177, filed on Apr. 8, 2010, now Pat. No. 8,832,906, application No. 14/502,799, filed on Sep. 30, 2014, which is a continuation-in-part of application No. 14/374,442, filed as application No. PCT/EP2013/057416 on Apr. 9, 2013, now Pat. No. 9,376,871, which is a continuation-in-part of application No. 12/756,173, filed on Apr. 7, 2010, now Pat. No. 8,763,690.

(60) Provisional application No. 61/287,665, filed on Dec. 17, 2009, provisional application No. 61/237,202, filed on Aug. 26, 2009, provisional application No. 61/221,716, filed on Jun. 30, 2009, provisional application No. 61/167,482, filed on Apr. 7, 2009.

(56) References Cited

U.S. PATENT DOCUMENTS

| | | | |
|---|---|---|---|
| 2,496,402 | A | 2/1950 | McVeigh et al. |
| 2,797,756 | A | 7/1957 | Hall, Sr. |
| 2,824,613 | A | 2/1958 | Baker et al. |
| 2,841,226 | A | 7/1958 | Conrad et al. |
| 2,855,052 | A | 10/1958 | Wright et al. |
| 2,962,313 | A | 11/1960 | Conrad |
| 2,986,417 | A | 5/1961 | Baker |
| 3,012,881 | A | 12/1961 | Cape |
| 3,040,405 | A | 6/1962 | Solum |
| 3,063,760 | A | 11/1962 | Gifford |
| 3,124,196 | A | 3/1964 | Solum |
| 3,292,708 | A | 12/1966 | Mundt |
| 3,360,846 | A | 1/1968 | Schellstede et al. |
| 3,563,575 | A | 2/1971 | Sanford |
| 3,566,965 | A | 3/1971 | Solum |
| 3,643,739 | A | 2/1972 | Hall, Sr. |
| 3,652,138 | A | 3/1972 | Collett |
| 3,916,998 | A | 11/1975 | Bass, Jr. et al. |
| 4,101,713 | A | 7/1978 | Hirsch et al. |
| 4,146,060 | A | 3/1979 | Garrett |
| 4,363,360 | A | 12/1982 | Richey |
| 4,367,053 | A | 1/1983 | Stratienko et al. |
| 4,434,125 | A | 2/1984 | Lavender et al. |
| 4,473,401 | A | 9/1984 | Masumoto et al. |
| 4,531,582 | A | 7/1985 | Muse et al. |
| 4,630,692 | A | 12/1986 | Ecer |
| 4,634,314 | A | 1/1987 | Pierce |
| 4,665,996 | A | 5/1987 | Foroulis et al. |
| 4,822,415 | A | 4/1989 | Dorfman et al. |
| 5,004,153 | A | 4/1991 | Sawyer |
| H1192 | H * | 6/1993 | Keller ..... E21B 17/1028 166/241.6 |
| 5,340,615 | A | 8/1994 | Browning |
| 5,384,164 | A | 1/1995 | Browning |
| 5,501,281 | A | 3/1996 | White et al. |
| 5,517,878 | A | 5/1996 | Klein et al. |
| 5,652,028 | A | 7/1997 | Taylor et al. |
| 5,697,442 | A | 12/1997 | Baldridge |
| 5,706,894 | A | 1/1998 | Hawkins, III |
| 5,743,302 | A | 4/1998 | McNeely |
| 5,817,952 | A | 10/1998 | Swisher et al. |
| 5,860,760 | A | 1/1999 | Kirk |
| 5,908,072 | A | 6/1999 | Hawkins |
| 5,932,293 | A | 8/1999 | Belashchenko et al. |
| 5,979,508 | A | 11/1999 | Cherrington |
| 6,083,330 | A | 7/2000 | Moskowitz |
| 6,199,633 | B1 | 3/2001 | Longbottom |
| 6,361,243 | B1 | 3/2002 | Geib |
| 6,484,803 | B1 | 11/2002 | Gremillion |
| 6,503,576 | B1 | 1/2003 | Russo et al. |
| 6,557,654 | B1 | 5/2003 | Murray |
| 6,571,472 | B2 | 6/2003 | Berry et al. |
| 6,575,350 | B2 | 6/2003 | Evans et al. |
| 6,578,539 | B2 | 6/2003 | Barbezat |
| 6,634,781 | B2 | 10/2003 | Bowens et al. |
| 6,649,682 | B1 | 11/2003 | Breton et al. |
| 6,679,325 | B2 | 1/2004 | Buytaert |
| 6,679,335 | B2 | 1/2004 | Slack et al. |
| 6,957,704 | B2 | 10/2005 | Rogers et al. |
| 7,105,205 | B2 | 9/2006 | Clayton et al. |
| 7,139,219 | B2 | 11/2006 | Kolle et al. |
| 7,159,619 | B2 | 1/2007 | Latiolais, Jr. et al. |
| 7,216,814 | B2 | 5/2007 | Gardega |
| 7,487,840 | B2 | 2/2009 | Gammage et al. |
| 8,832,906 | B2 | 9/2014 | Buytaert et al. |
| 2001/0030067 | A1 | 10/2001 | Evans et al. |
| 2002/0139537 | A1 | 10/2002 | Young et al. |
| 2003/0019637 | A1 | 1/2003 | Slack et al. |
| 2003/0150611 | A1 | 8/2003 | Buytaert |
| 2003/0219544 | A1 | 11/2003 | Smith et al. |
| 2004/0140021 | A1 | 7/2004 | Branagan |
| 2004/0265503 | A1 | 12/2004 | Clayton et al. |
| 2005/0178558 | A1 | 8/2005 | Kolle et al. |
| 2005/0199739 | A1 | 9/2005 | Kuroda et al. |
| 2005/0241147 | A1 | 11/2005 | Arnold et al. |
| 2006/0062928 | A1 | 3/2006 | Lichtblau |
| 2006/0185908 | A1 | 8/2006 | Kembaiyan et al. |
| 2007/0243335 | A1 | 10/2007 | Belashchenko |
| 2007/0284037 | A1 | 12/2007 | Buytaert |
| 2008/0156488 | A1 | 7/2008 | Thornton |
| 2008/0217063 | A1 | 9/2008 | Moore et al. |
| 2009/0255666 | A1 | 10/2009 | Olsen et al. |
| 2010/0059218 | A1 | 3/2010 | Whitelaw |
| 2011/0114338 | A1 | 5/2011 | Casassa et al. |
| 2012/0186808 | A1 | 7/2012 | Lively et al. |
| 2012/0292043 | A1 | 11/2012 | Thornton |
| 2013/0025881 | A1 | 1/2013 | Buytaert et al. |
| 2014/0367085 | A1 | 12/2014 | Levie et al. |

FOREIGN PATENT DOCUMENTS

| | | | |
|---|---|---|---|
| GB | 2304753 | A | 3/1997 |
| GB | 2358418 | A | 7/2001 |
| GB | 2406951 | | 4/2005 |
| GB | 2408591 | A | 4/2005 |
| GB | 2431664 | A | 5/2007 |
| JP | 2000-052086 | A | 2/2000 |
| JP | 2004-068142 | A | 3/2004 |
| JP | 2010-242173 | A | 10/2010 |
| KR | 950014072 | B1 | 11/1995 |
| WO | 0204781 | A1 | 1/2002 |
| WO | 2004015238 | A1 | 2/2004 |
| WO | 2007143324 | A1 | 12/2007 |

OTHER PUBLICATIONS

Final Office Action dated Feb. 1, 2013, U.S. Appl. No. 12/756,177, filed Apr. 8, 2010, pp. 1-45.

Non-Final Office Action dated Aug. 14, 2013, U.S. Appl. No. 12/756,177, filed Apr. 8, 2010, pp. 1-40.

Final Office Action dated Mar. 13, 2014, U.S. Appl. No. 12/756,177, filed Apr. 8, 2010, pp. 1-21.

PCT International Search Report mailed Dec. 23, 2010, PCT Application No. PCT/US2010/037441 filed Jun. 4, 2010, pp. 1-5.

Non-Final Office Action dated Oct. 24, 2013, U.S. Appl. No. 13/191,074, filed Jul. 26, 2011, pp. 1-20.

Final Office Action dated Apr. 9, 2014, U.S. Appl. No. 13/191,074, filed Jul. 26, 2011, pp. 1-20.

PCT International Search Report mailed Jul. 16, 2014, PCT Application No. PCT/EP2013/057416 filed Apr. 9, 2013, pp. 1-6.

Combined Search and Examination Report dated Feb. 5, 2014, GB Application No. 1215868.9, pp. 1-2.

David E. Y. Levie et al., "Modified Tubular", U.S. Appl. No. 14/374,442, filed Jul. 24, 2014.

Ok Joo Lee (Authorized Officer), International Search Report and Written Opinion dated Dec. 11, 2014, International Application No. PCT/US2014/053206, filed Aug. 28, 2014, pp. 1-10.

Pro-Fusion Technologies, Inc., The Plasma Arc Welding Process, [online], retrieved from the internet Aug. 27, 2014, http://www.pro-fusiononline.com/welding/plasma.htm, pp. 1-3.

(56) References Cited

OTHER PUBLICATIONS

Gordon England, Arc Wire Thermal Spray Process (ArcSpray), [online], retrieved from the internet Aug. 27, 2014, http://www.gordonengland.co.uk/aws.htm, pp. 1-3.
Jong-Hwan Kim et al., High Velocity Oxyfuel Deposition for Low Surface Roughness, PS304 Self-Lubricating composite Coatings, Tribology Transactions, 47, 2004, retrieved from the internet Aug. 27, 2014, http://www.tandfonline.com/doi/pdf/10.1080/05698190490278958, pp. 157-169.
Final Office Action dated Dec. 9, 2015, U.S. Appl. No. 14/374,442, filed Jul. 24, 2014, pp. 1-9.
Non-Final Office Action dated Aug. 21, 2015, U.S. Appl. No. 14/374,442, filed Jul. 24, 2014, pp. 1-9.

* cited by examiner

CENTRALIZER ASSEMBLY AND METHOD FOR ATTACHING TO A TUBULAR

CROSS-REFERENCE TO RELATED APPLICATIONS

This application is a continuation-in-part of U.S. patent application Ser. No. 13/191,074, filed on Jul. 26, 2011, now U.S. Pat. No. 8,851,168. This application is also a continuation-in-part of U.S. patent application Ser. No. 14/046,320, filed on Oct. 4, 2013, which is a divisional of U.S. patent application Ser. No. 12/756,177, filed on Apr. 8, 2010, now U.S. Pat. No. 8,832,906. This application is further a continuation-in-part of U.S. patent application Ser. No. 14/374,442, which is a national-stage entry of PCT/EP2013/057416, filed on Apr. 9, 2014, which claims priority to UK Application No. GB1215868.9, filed on Sep. 5, 2012. The entirety of each of these priority documents is incorporated herein by reference.

BACKGROUND

Centralizers may be coupled with oilfield tubulars (e.g., casing, drill pipe, etc.), so as to maintain a generally annular standoff between the oilfield tubular and a surrounding tubular (e.g., casing, liner, or the wellbore wall itself) in which the oilfield tubular is disposed. The centralizers may be coupled with the tubulars, e.g., disposed on, and generally maintained at an axial position, or a range of axial positions, with respect to the tubular. Among other applications, centralizers are commonly employed to facilitate filling the annulus between the oilfield tubular and the surrounding tubular with cement.

One type of centralizer is a bow-spring centralizer. Bow-spring centralizers generally have two annular end collars and multiple, flexible, bow-shaped members extending therebetween. The bow-shaped, centralizing members may elastically flex in a radial direction, so as to engage the wellbore wall. Other types of centralizers include rigid and semi-rigid centralizers, which may have less-flexible, or rigid, centralizing members, as compared to the bow-spring centralizer.

Some wells present restrictions that reduce the diameter differential between the surrounding tubular and the oilfield tubular (i.e., the "tolerance"). Such restrictions may be caused, for example, by an inner-diameter restriction, a dogleg, a turn, sloughing, etc. The tolerance provided by some restrictions may be relatively small. Accordingly, when encountering these close-tolerance restrictions, bow-spring centralizers may be forced to contract the centralizing members thereof radially against the tubular, so that the centralizer may pass through the restriction while at least substantially maintaining structural integrity.

Once past the restriction (e.g., as the tubular is moved in the wellbore), and thus exiting the close-tolerance section, the collapsed centralizing members may elastically return generally to their pre-collapsed (i.e., expanded) state. A failure to elastically return to their pre-collapsed state may cause the centralizing members to not properly centralize the tubular, potentially allowing the tubular to contact the wellbore wall or otherwise form a non-uniform standoff. When used in advance of wellbore cementing, such a non-uniform standoff may reduce a wall thickness of the cement around a portion of the tubular.

SUMMARY

Embodiments of the disclosure may provide a centralizer including a stop collar configured to be rotationally and axially fixed to a tubular, the stop collar defining an outer diameter. The centralizer also includes a body including a first end collar and one or more centralizing ribs coupled with the first end collar and configured to centralize the tubular when installed thereon. The first end collar has an inner diameter that is larger than the outer diameter of the stop collar. The centralizer also includes a retainer coupled with the first end collar and having an inner diameter that is smaller than the outer diameter of the stop collar. The retainer is configured to prevent the first end collar from sliding past the stop collar in at least one axial direction.

Embodiments of the disclosure may also provide a method for assembling a centralizer on a tubular. The method includes attaching a stop collar to the tubular. Attaching the stop collar includes at least one of: spraying a thermal spray metal on the tubular, so as to form the stop collar in attachment with the tubular, or forming an interference fit between the stop collar and the tubular, or positioning a shell on the tubular and injecting a bonding material between the shell and the tubular. The method also includes positioning an end collar of the centralizer at least partially over the stop collar. At least a portion of the end collar defines an inner diameter that is larger than an outer diameter of the stop collar. The method further includes coupling a retainer to the end collar. At least a portion of the retainer defines an inner diameter that is smaller than the outer diameter of the stop collar, so as to prevent the end collar from sliding away from the stop collar in at least one direction relative to the tubular.

Embodiments of the disclosure may further provide a centralizer assembly for connecting to a tubular. The assembly includes a first stop collar fixed in place on the tubular, and a first end collar that is sized to slide axially over the first stop collar. The assembly also includes a first retainer coupled with the first end collar. The first retainer prevents the first stop collar from sliding past the first stop collar in at least one axial direction. The assembly also includes a plurality of ribs coupled with the first end collar and configured to engage a surrounding tubular in which the tubular is disposed.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
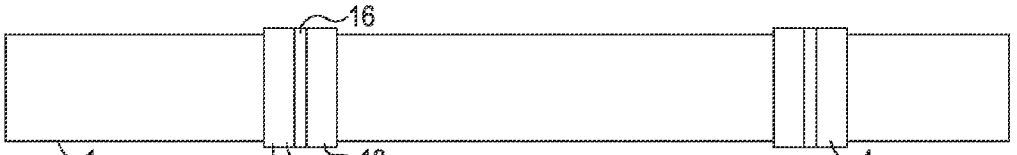
FIG. 1A illustrates a side perspective view of a tubular with two stop collars attached thereto, according to an embodiment.

Embodiments are described below merely as examples and are not intended to limit the scope of the appended claims. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Further, the embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. However, various entities may refer to the same component by different names, and as such, the naming convention for the elements described herein is not intended to be limiting, unless a particular term is otherwise specifically defined herein. Further, the naming convention used herein is not intended to distinguish between components that differ in name but not function.

Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "A, or B, or both A and B," unless otherwise expressly specified herein. Finally, the terms pipe, tubular, tubular member, casing, liner, tubing, drill pipe, drill string and other like terms can be used interchangeably. These terms may be used in combination with joint to refer to a single unitary length, a stand to refer to one or more, and typically two or three, interconnected joints, or a string to refer to two or more interconnected joints.

Turning now to the illustrated embodiments, FIG. 1A illustrates a perspective view of an oilfield tubular 1 to be centralized within a surrounding tubular, according to an embodiment. The oilfield tubular may be a casing, drill pipe, or any other tubular or string of tubulars. The surrounding tubular may be any tubular into which the oilfield tubular 1 may be deployed, including, but not limited to, the wellbore wall, a casing, and a liner.

Although not shown, a proximal end of tubular 1 may be attached to a lifting device, such as the drawworks of a drilling rig. The proximal end (i.e., the top or "uphole" end) of the tubular 1 may be attached to a rotary device, e.g., a rotary table (kelly) of a drilling rig or top drive of a rig that is suspended from a lifting device, such as the drawworks of a drilling rig.

Figures 1B, 2B, 3B, 4B:
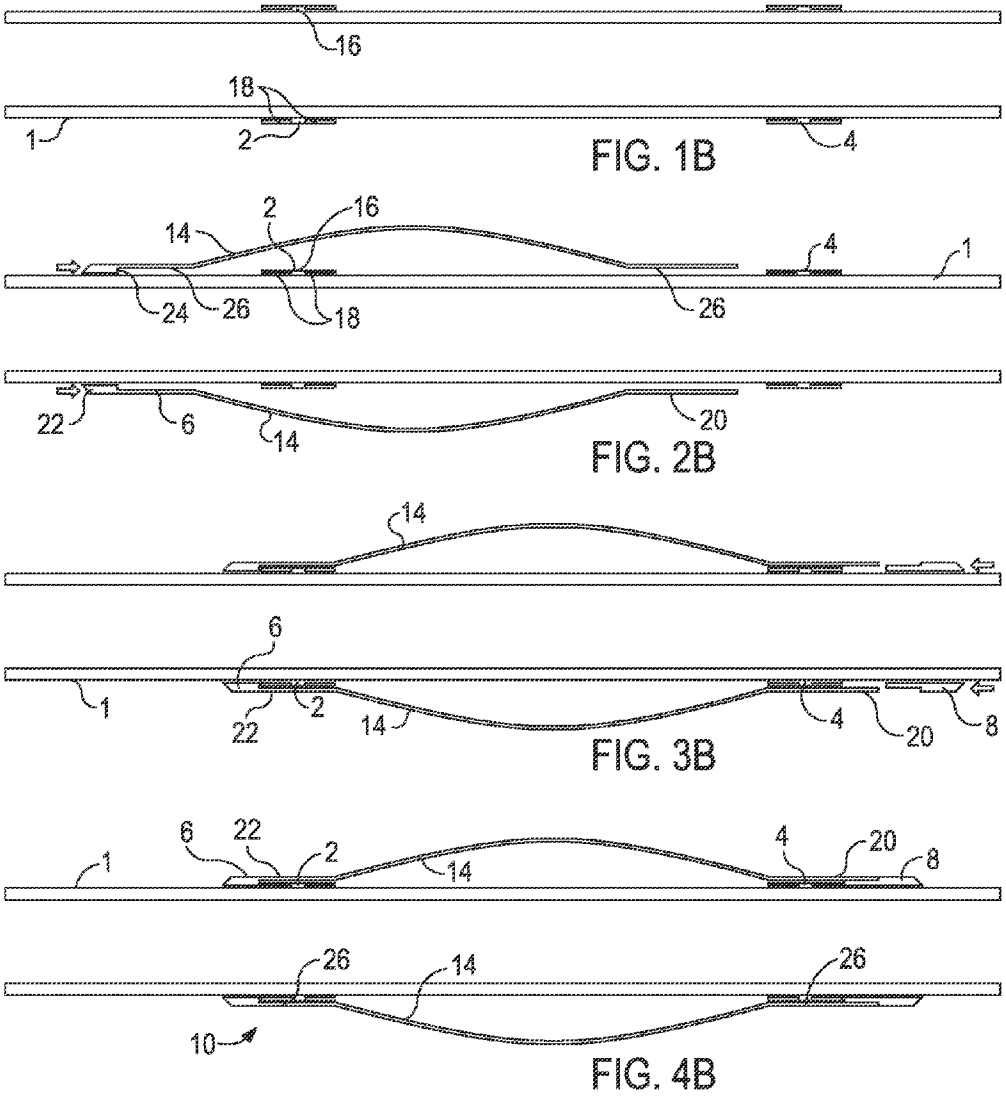
FIG. 1B illustrates a side cross-sectional view of the tubular with two stop collars attached thereto, according to an embodiment.
FIG. 2B illustrates a side cross-sectional view of the body of the centralizer being disposed on the tubular and past a first stop collar, according to an embodiment.
FIG. 3B illustrates a side cross-sectional view of the body of the centralizer positioned on the tubular, past the stop collars, and the retainer being positioned on the tubular, according to an embodiment.
FIG. 4B illustrates a side cross-sectional view of the retainer attached to the tubular body to form the centralizer, according to an embodiment.

FIG. 1B illustrates a cross-sectional view of the oilfield tubular 1 (hereinafter, "tubular 1") with two stop collars 2, 4 attached thereto, according to an embodiment. The tubular 1, which may include a bore that runs longitudinally through the tubular 1, may be coupled with the two stop collars 2, 4 on an exterior surface (e.g., an outer diameter) of the tubular 1, as shown. However, in other embodiments, the stop collars 2, 4 may be integral with the tubular 1. Furthermore, although two stop collars 2, 4 are shown, a single stop collar or three or more stop collars may be used.

The stop collars 2, 4 may be secured to the tubular 1 via mechanical fasteners (e.g., set screws, teeth, nuts and/or bolts), adhesives (e.g., epoxy), welding, crimping, and/or interference fit. In the illustrated embodiment, the stop collars 2, 4 are coupled to the tubular 1 using an interference fit (e.g., press fit). Such stop collars may be provided, for example, according to one or more embodiments described in U.S. Pat. No. 8,832,906, the entirety of which is incorporated herein by reference. In an embodiment, the stop collars 2, 4 may be free from marking structures, such as teeth, which may bite into the exterior of the tubular 1. In other embodiments, one or both stop collar 2, 4, may include marking structures.

In an embodiment, one or more of the stop collars 2, 4 may be at least partially formed using a thermal spray metal. The thermal spray metal may be applied to the outer diameter surface of the tubular 1, e.g., in relatively thin layers, one on top of the previous. One example of such a process, and an example of a thermal spray composition for use therewith, are described in U.S. patent application Ser. No. 14/471,630 and/or U.S. Pat. No. 7,487,840. The entirety of both of these disclosures is incorporated herein by reference.

As an example, the spray metal may be built up from the tubular 1, until the stop collars 2, 4 provide a desired upset (i.e., shoulder) extending outwards from the tubular 1. In some embodiments, the stop collar 2, 4, provided by a thermal spray, may extend from about 0.10 inches, about 0.50 inches, or about 1.00 inches to about 2.00 inches, about 2.50 inches, or about 3.00 inches outwards from the tubular 1.

Figure 6A:
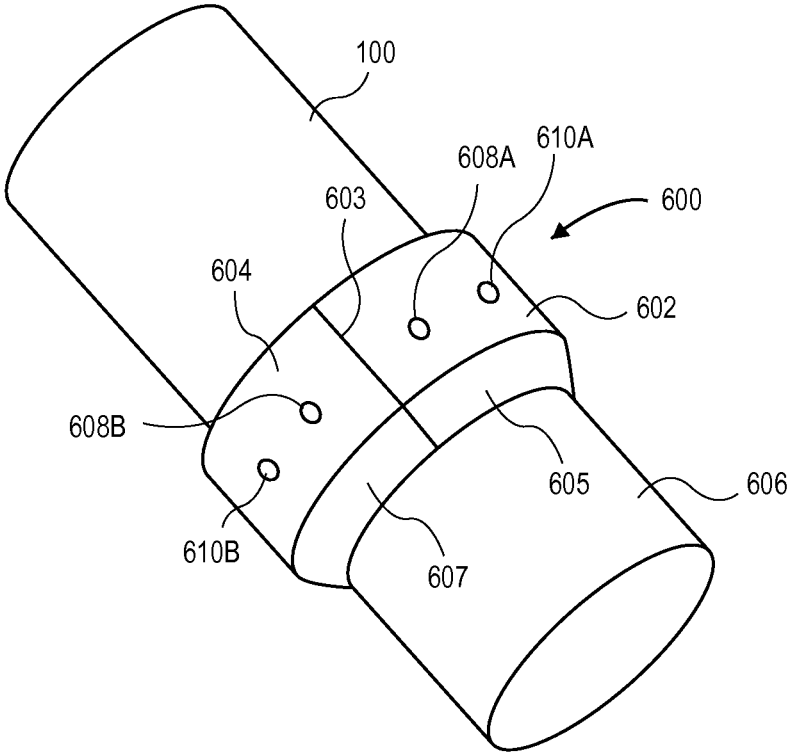
FIG. 6A illustrates a raised perspective view of a molded stop collar, according to an embodiment.
Figure 6B:
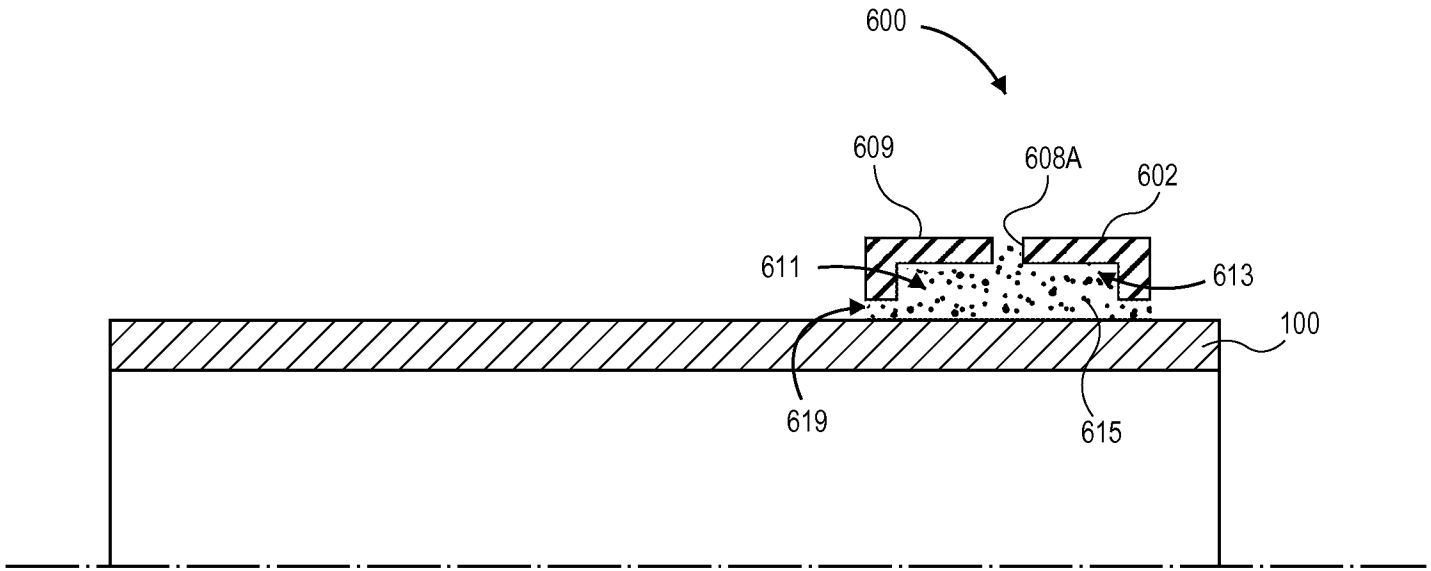
FIG. 6B illustrates a side cross-sectional view of the molded stop collar, according to an embodiment.
Figure 6C:
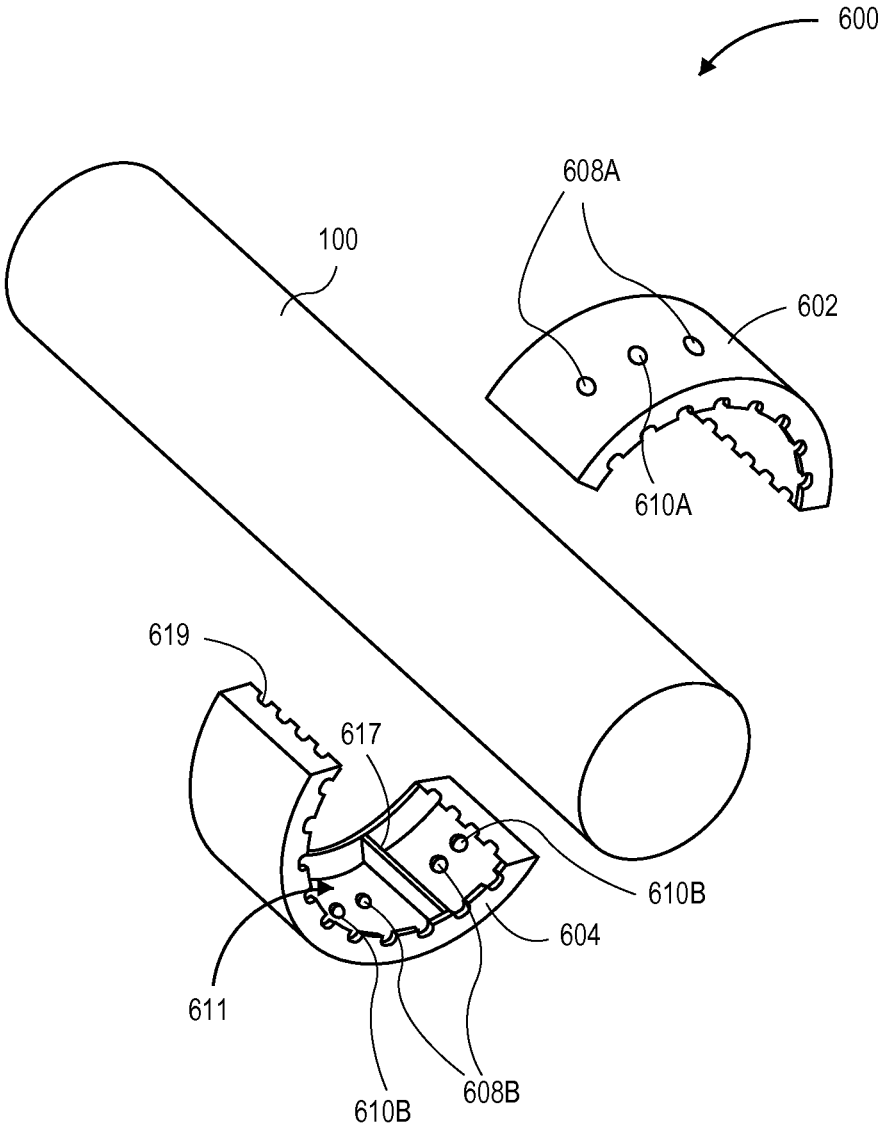
FIG. 6C illustrates a perspective view of the molded stop collar during assembly thereof, according to an embodiment.

In other embodiments, the stop collars 2, 4 may be formed from an epoxy, a composite, or another molded material connected to the tubular 1. FIGS. 6A-6C illustrate an example of such a molded stop collar 600. In particular, FIG. 6A illustrates a raised perspective view of the molded stop collar 600 disposed on a tubular 100, according to an embodiment. FIG. 6B illustrates half of the stop collar 600, in cross-section, installed on the tubular 100, according to an embodiment, with it being appreciated that the other half in cross-section may look the same or substantially the same. FIG. 6C illustrates a perspective view of the stop collar 600 during assembly thereof, according to an embodiment. In some embodiments, the stop collar 600 may be formed or otherwise constructed according to one or more embodiments of U.S. patent application Ser. No. 14/374,442, the entirety of which is incorporated herein by reference.

The stop collar 600 may include two or more arcuate shells (two shown: 602, 604). The shells 602, 604 may be disposed at least partially around a tubular 100. The shells 602, 604 may physically contact one another on at least one circumferential end thereof, so as to define a generally axially-extending interface 603 therebetween. In other embodiments, the shells 602, 604 may be spaced circumferentially apart, such that one or more gaps are formed between the circumferential ends of the shells 602, 604. Further, in embodiments including three or more shells, the shells may be abutting, circumferentially end-on-end, some may be abutting and some spaced apart, or all may be spaced apart.

The shells 602, 604 may define inlet ports 608A, 608B, respectively, and outlet ports 610A, 610B. The inlet and outlet ports 608A, 608B, 610A, 610B may extend through an outer wall 609 (see, e.g., FIG. 6B) of the shells 602, 604 and communicate with a cavity 611 defined within the shells 602, 604. The shells 602, 604 may also include one or more braces or struts 617, extending across the internal cavities 611, so as to increase a structural integrity of the shells 602, 604. An inner surface 613 of the shells 602, 604 (e.g., defining the internal cavity 611) may include protrusions, scales, etc. so as to provide a keying surface for a bonding material 615. Further, the shells 602, 604 may define a beveled region 605, 607 along at least a portion of the periphery thereof, and may also include one or more ridges on the periphery.

The shells 602, 604 may be formed at least partially from a fiber mat infused with a resin matrix. Further, ceramic particulates, such as zirconium dioxide or silicon nitride, may be applied to the resin-infused fiber mat. Further, a friction-modifying material, such as fluorocarbon particulates, may be applied to all or a part of the shells 602, 604, so as to provide a low-friction surface on at least a portion of the outer diameter of the stop collar 600.

The shells 602, 604 may be positioned on the tubular 100, so as to form at least a partial ring around the tubular 100. The shells 602, 604 may be temporarily held in position using a strap or another device. The bonding material 615 may then be injected through the inlet ports 608, 610. Suction may be applied to the outlet ports 610A, 610B, so as to evacuate air from the cavity 611 during or prior to injection of the bonding material 615. In other embodiments, the injection of the bonding material 615 itself may force air, or any other gases or fluids out of the outlet ports 610A, 610B, without requiring an externally-generated pressure differential (e.g., suction) to be applied to the outlet ports 610A, 610B.

The bonding material 615 may flow into the cavity 611 and may, e.g., upon curing, connect the shell 602, 604 with the tubular 1. In some embodiments, the bonding material 615 may proceed through recesses 619 formed along the periphery of the shells 602, 604. Optionally, one or more bonding materials may remain uncured, at least initially, within the shell 602, 604, and may be expelled when the shell 602, 604 is compressed, e.g., so as to increase a coupling strength with another structure received at least partially around the stop collar 600.

The bonding material 615 may thus form a continuous or segmented ring structure within the one or more shells 602, 604. In an embodiment in which the ring structure formed from the bonding material 615 is segmented, a gap may be defined between adjacent sections of bonding material 615 where the walls of the shells 602, 604 form the interface 603. In other embodiments, however, the walls of the shells 602, 604 may not segment the bonding material 615, and thus no gap may be formed.

Referring again to FIGS. 1A and 1B, the stop collars 2, 4 may have a radial thickness equal to or less than ⅛" (e.g., equal or less than a positive OD of ¼"), but in other embodiments, may have a radial thickness of up to 3.00" or more. Further, the stop collars 2, 4 may extend circumferentially about the periphery of tubular 1, e.g., forming a generally cylindrical shape. In an interference fit embodiment, the stop collars 2, 4 may include a base 16 having a bore to receive the tubular 1. The stop collars 2, 4, may also include a set of one or more fingers extending axially along the base 16 in a first direction, and set of one or more fingers extending axially along the base 16 in a second direction. Sleeves 18 may also be provided, having a bore receivable onto the set of fingers in an interference-fit with the fingers between the bore of the sleeves 18 and the tubular 1 to secure the stop collar to the tubular.

Although the stop collar 2 is depicted having two sets of sleeves 18 (which are received on fingers), the stop collars 2, 4, may each instead have one set fingers and one sleeve 18 received thereon, or three or more pairs of fingers and sleeves. In an embodiment, the stop collars 2, 4 may each have an axial length of about 9 inches. In an embodiment, each of the sleeves 18 may have an axial length of about 4 inches. In an embodiment, each of the bases 16 may have an axial length of about one inch, e.g., the axial length of the base 16 not including the finger(s) to be covered by the sleeve 18. The stop collars 2, 4 may be installed at a pipe yard and/or rig site and/or may be installed anywhere on the external surface of a tubular, for example, not requiring a separate tubular (sub) to be utilized.

Figure 2A:
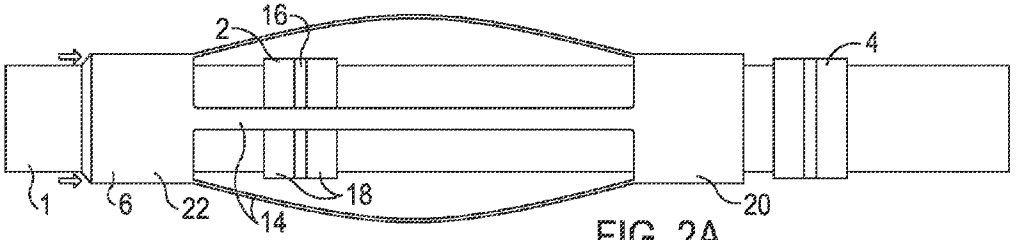
FIG. 2A illustrates a side perspective view of the body of a centralizer being disposed onto the tubular and past a first stop collar, according to an embodiment.

FIG. 2A illustrates a side perspective view of a body 6 of a centralizer being disposed onto the tubular 1 and past the stop collar 2, with the stop collar 2 having been attached to the tubular 1, according to an embodiment. FIG. 2B illustrates a cross-sectional view of the body 6 of the centralizer being disposed onto the tubular and past (e.g., over) the stop collar 2, according to an embodiment.

In an embodiment, the body 6 of the centralizer may include a first end collar 20 and a second end collar 22, with a plurality of ribs, e.g., rigid members, semi-rigid members, or, as shown, a plurality of collapsible bows 14, extending therebetween. The first and second collars 20, 22 may be generally cylindrical, and configured to be received around and generally concentric with the tubular 1. In an embodiment, the body 6 of the centralizer may be a single-piece centralizer, and may be formed by a rolling and/or machining a flat plate, such as described in U.S. Patent Publication No. 2014/0096888, the entirety of which is incorporated by reference herein.

The bows 14 may be flexible, e.g., collapsible inwards so as to allow for inward radial movement, e.g., to pass through a restriction. Although three bows 14 are visible in FIG. 2A, any number of bows 14 may be included in various embodiments. The bows 14 may be spaced circumferentially equidistant from one another, or non-uniformly spaced apart from each other. The bows 14 may extend parallel to the longitudinal axis of the centralizer (as shown) or they may be skewed, helical, etc. The bows 14 may have a uniform and/or varying thickness and/or width. Further the bows 14 may have a thickness equal or less than ⅛" (equal or less than a positive radial protrusion of 3/16"), e.g., when the bows 14 are fully collapsed along the exterior of the tubular. In another embodiment, the bows 14 may have a radial thickness equal or less than 1/16" (equal or less than a positive OD of ⅛"), e.g., when the bows are fully collapsed along the exterior of the tubular. The bows 14 may be formed from a material that allows the bows 14 to be fully collapsed (e.g., flattened) inside a close-tolerance restriction without, or substantially without, being yielded, e.g., the spring properties remain generally unchanged after exiting the close-tolerance restriction and thus generate a generally repeatable restoring force before and after passing through such restriction.

As shown, e.g. in FIG. 2B, the first end collar 20 of the centralizer body 6 may have an inner diameter that is larger than an outer diameter of one or both stop collars 2, 4. Accordingly, the first end collar 20 may slide axially over the stop collar(s) 2, 4. The second end collar 22 of the centralizer body 6, on the other hand, may have an inner diameter that is smaller than the outer diameter of one or both of the stop collars 2, 4. For example, the second end collar 22 may include a shoulder 24 therein, e.g., to contact the stop collar 2 and prevent axial movement past the stop collar 2. The shoulder 24 may extend circumferentially along the inner diameter of the second end collar 22, either partially or entirely forming a ring-shape.

The first end collar 20 and/or the second end collar 22 (and/or retainer 8, as discussed below) may have a radial thickness equal or less than 1/16" (equal or less than a positive OD of ⅛"). The first end collar 20 and/or the second end collar 22 (and/or the retainer 8, as discussed below) may have a uniform and/or varying thickness and/or width as desired. The bows 14, first end collar 20, and/or second end collar 22 (and/or the retainer 8, as discussed below) may have a maximum radial thickness equal or less than 3/16" (equal or less than a positive OD of ⅜"), e.g., when the bows 14 are fully collapsed. The centralizer body 6 may have a maximum radial thickness equal or less than about 3/16" (equal or less than a positive OD of about ⅜"), e.g., when the bows 14 are fully collapsed along the exterior of the tubular 1. The first end collar 20 and/or the second end collar 22 (and/or the retainer 8, as discussed below) may have a tapered leading edge, e.g., to aid in the passage through a restriction. As depicted, the minimum bore defined by the centralizer body 6 may be larger than the outer diameter of the tubular.

The bows 14, first end collar 20 and/or second end collar 22 (and/or the retainer 8, as discussed below) may be at least partially constructed from a material having a yield strength of at least about 200,000 pounds per square inch (psi). In an embodiment, the bows 14 each have a yield strength of at least about 200,000 psi. The bows 14, first end collar 20, and/or second end collar 22 (and/or the retainer 8, as discussed below) may be constructed at least partially from a beryllium copper alloy, for example, as currently available from the Materion Corporation. The bows 14, first end collar 20, and second end collar 22 may be a unitary piece, e.g., milled or forged from a single tube. In another embodiment, the bows 14 may be formed separately and connected to the first end collar 20 and second end collar 22 via welding, fastening, or any other process or device.

Any portion of the centralizer body 6 (e.g., the end collars 20, 22 and/or bows 14), and/or the retainer 8 may include an outer surface having a low-friction material. In an embodiment, the bows 14, e.g., the outer surface thereof and/or a portion of the outer surface of the bows 14 configured to contact the borehole and/or restriction when in use, may include such a low-friction material. In an embodiment, the low-friction material may have a coefficient of friction equal to or less than about 0.02. One example of such a material is a ceramic alloy created from an alloy of boron, aluminum and magnesium ($AlMgB_{14}$) and titanium boride ($TiB_2$), such as is commonly referred to as BAM™ and available from New Tech Ceramics, Inc. In other embodiments, the low-friction material may have a coefficient of friction that is equal to or less than about 0.05. One example of such a material is polytetrafluoroethylene (PTFE), a fluoropolymer resin commonly referred to as TEFLON® from the DuPont Corporation. In still other embodiments, the centralizer body 6, or any portion thereof, may be coated with a thermal spray material, which may reduce friction and increase wear-resistance.

In an embodiment, the low-friction material may be applied to the exterior surface of the bows 14 to create a coating with a thickness suited to the environmental conditions experienced during run-in of the tubular 1 into a wellbore. In an embodiment, the low-friction material is applied to the bows 14 (or any other portion of the centralizer body 6 and/or the retainer 8) in a layer that is about 2 microns thick. The low-friction material may reduce the starting (static) and running (dynamic) force as compared to a centralizer without a lower friction material on a surface thereof (e.g., on the bows).

For example, a centralizer with a low-friction material applied (e.g., on the bows) may allow bows of a relatively rigid material (e.g., a material having have a yield strength of at least about 200,000 psi) to be utilized where, without such a low-friction material on the bows 14 (at least), the starting and/or running forces might exceed the capabilities of the machinery to run the tubular and centralizer(s) assembly into the wellbore. Multiple centralizers (e.g., tens, hundreds, or more) may be used on a tubular (e.g., tubular string) and the starting and/or running force would thus increase based on the multiple contact areas with the borehole and/or restrictions. This may be referred to as the "drag force." In an embodiment, the drag force generated by the bows 14 of each of the centralizers added together may be less than the weight of the tubular string, e.g., the weight of the tubular(s) when disposed in drilling fluid (mud), onto which the centralizer is installed to allow insertion into the borehole.

Figure 3A:
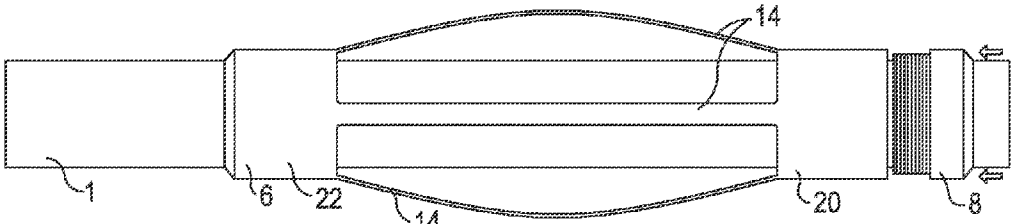
FIG. 3A illustrates a side perspective view of the body of the centralizer disposed on the tubular, partially past stop collars, and a retainer being disposed on the tubular, according to an embodiment.

FIG. 3A illustrates a side perspective view of the centralizer body 6 disposed on the tubular 1, with the first end collar 20 having slid past the stop collar 2, according to an embodiment. In addition, the retainer 8 is shown disposed onto the tubular 1, and is being slid toward the stop collar 4 (and the centralizer body 6) from the opposite end of the tubular 1.

The retainer 8 may have a bore that, at least in part, defines an inner diameter that is smaller than the outer diameter of the stop collars 4, so as to block passage of the retainer 8 axially over the stop collar 4. Further, the retainer 8 may be coupled with the first end collar 20, and may thereby provide a predetermined end-range for axial movement of the first end collar 20 in at least one axial direction with respect to the stop collar 4. The retainer 8 may be a single piece (e.g., circumferentially continuous) or multiple pieces so as to allow lateral installation about a tubular.

Additionally, FIG. 3B illustrates a cross-sectional view similar to the perspective view of FIG. 3A, showing the centralizer body 6 disposed onto the tubular 1 and slid past the stop collar 2 and the stop collar 4, and the retainer 8 being slid toward the stop collar 4. The retainer 8 may include a stepped profile, as shown, having one portion sized to fit between the tubular 1 and the first end collar 20, and another that is larger. The smaller portion may have threads, which may mesh with threads formed on the inner diameter of the first end collar 20. In other embodiments, the entire retainer 8 may be disposed within the bore of the end collar 20. A portion or an entire retainer (e.g., the axial extent thereof) may be disposed around a collar of the centralizer, e.g., second collar 20.

The retainer 8 and/or centralizer body 6 may be installed manually or via an installation machine (e.g., automatically). Although not depicted, both ends of the centralizer body 6 may receive a retainer 8, e.g., each end of the centralizer body 6 taking the form shown with first end collar 20 and attachable retainer 8.

Figure 4A:
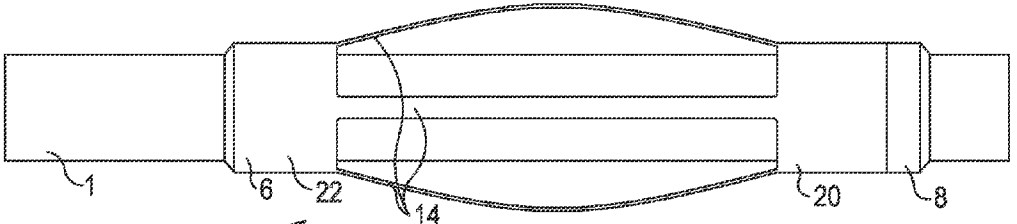
FIG. 4A illustrates a side perspective view of the retainer attached to the body to form the centralizer, according to an embodiment.

FIG. 4A illustrates a perspective view of the retainer 8 attached to the first end collar 20 of the centralizer body 6, thereby forming a centralizer 10, according to an embodiment. FIG. 4B illustrates a cross-sectional view of the retainer 8 attached to the centralizer body 6 to form the centralizer 10 of FIG. 4A. The retainer 8 may attach to the centralizer body 6 by threads, as depicted. Additionally or alternatively, the retainer 8 may attach to the centralizer body 6 via adhesion or welding. Further, the retainer 8 may attach to the centralizer body 6 via a mechanical interaction or any other attachment process or device. The retainer 8 may be permanently or removably attached to the centralizer body 6. Further, the retainer 8 may form a shoulder therein, e.g., on an end proximal the centralizer body 6, to contact the stop collar(s) 2, 4.

In maintaining the end collars 20, 22 in an axial range of positions with respect to the tubular 1, the stop collars 2, 4 interacting with the end collars 20, 22 (and/or the retainer 8 attached thereto) may provide an end range for the end collars 20, 22 adducting together. Accordingly, the stop collars 2, 4 may be positioned on the tubular 1 such that the first end collar 20 and second end collar 22 may slide close enough together for the bows 14 to expand radially outward to a desired radial position. The end collars 20, 22 may also be rotatable relative to the tubular 1, whether engaging the stop collars 2, 4 or not, in at least some embodiments.

The centralizer 10 may include a recess 26 (see FIGS. 2B and 4B), which may receive one of the stop collars 2, 4 therein. The recess 26 may protect the stop collar(s) 2, 4, from contact with the borehole (and any restrictions, etc.) or other foreign bodies. As the centralizer 10 is pulled through a borehole, e.g., a restriction, by one or more of the stop collars 2, 4 on a tubular 1, the stop collars 2, 4 may be disposed into the recess 26 of the centralizer 10.

In an embodiment, a method of manufacturing a centralizer includes forming (e.g., machining) the tubular body, bows and/or retainer. The centralizer and/or bows (e.g., an external surface thereof) may be coated with a material having a coefficient of friction equal or less than about 0.02, for example, by particle vapor deposition, pulsed laser deposition or magnetron sputtering.

In an embodiment, a tubular with a stop collar may be centralized with a centralizer (e.g., centralizer 10) according to the embodiments of this disclosure. The centralizer may be mounted on a tubular such that a stop collar(s) of the tubular is positioned between a first and second collar of the centralizer, with the stop collar(s) axially retaining the centralizer. In an embodiment, a stop collar positioned proximal to the bows and a centralizer collar (e.g., stop collar 2 contacting the shoulder 24 of end collar 22 as in the Figures) allows the bows to be pulled (e.g., through a restriction) so as to urge the radial collapse of the bows, as opposed to being pushed if the stop collar was positioned distal to bows so as to urge the radial expansion of the bows. In an embodiment, a centralizer is pulled through a restriction in the borehole by the stop collar contacting a shoulder (e.g., circumferentially extending) of the first collar or the second collar (e.g., the collar closest to the restriction upon entry) and collapsing the plurality of collapsible bows to allow passage through the restriction. Being able to "pull" a centralizer may aid in the reciprocation (e.g., movement into and out of the borehole) of the tubular, e.g., to traverse a restriction and/or evenly distribute cement (if there is a liquid cement slurry present) around the tubular.

In an embodiment, a centralizer may be rotated relative to the tubular (e.g., relative to a stop collar thereon). A tubular may be rotated while running into and/or out of a borehole to aid in the axial movement of the tubular, e.g., when traversing in the borehole dog legs, ledges, bridges, windows in an outer tubular, etc. A tubular may be rotated while the centralizer (e.g., the bows thereof) remains geostationary, e.g., when cement has been displaced into the annulus between the tubular and a borehole. For example, rotation may be utilized to facilitate an even cement distribution around the tubular. A centralizer (e.g., the components rotatable relative to the tubular) may be formed of a material having a yield strength of at least about 200,000 psi, for example, because such a material may provide a high resistance to abrasion and/or galling.

In an embodiment, the use of (e.g., bi-center) drill bits and/or under-reamers create an open hole (e.g., no external tubular) that is larger than the section of borehole above. A centralizer used in an enlarged open hole section may be selected (e.g., formed of a material) to offer a sufficient restoring force to properly centralize the tubular in the open hole, e.g., in non-vertically oriented borehole, such as a horizontal borehole section. High restoring and low starting and running forces have been found to be generally incompatible with conventional material (e.g., steel) centralizers as the bow material tends to plastically yield (i.e., fail) when subjected to high stress when entering and passing through a restriction (e.g., a close tolerance application). Once the bow material has exceeded its limit of elasticity, it no longer has its original spring properties and, as a result, an undesirably low restoring force (e.g., especially in an enlarged hole) may be expected with conventional material centralizers.

In an embodiment, a centralizer according to the disclosure herein may be used with a stop collar (such as an interference-fit, thermal spray, and/or molded stop collar) to position the centralizer anywhere on the tubular, e.g., along the length of the tubular. A plurality of centralizers per tubular (e.g., tubular joint) are sometimes used, e.g., when an optimum centralization of the tubular shoe track is desired. In an embodiment, a centralizer according to the disclosure herein may be used with a stop collar to allow installation of the centralizer(s) and stop collar(s) in a remote location (e.g., pipe yard or drilling rig site) instead of an assembly plant, thus resulting in time and costs savings. In an embodiment, a centralizer(s) according to the disclosure herein may be used with a stop collar(s) so as to keep the length of individual tubulars (e.g., joints) unchanged to allow the use of conventional semi-trailers and tubular handling equipment, as compared to adding axial extending subs which may not fit on conventional semi-trailers or drilling rigs.

In an embodiment, a centralizer according to the disclosure herein may be used with a stop collar to allow the tubular and centralizer assembly to traverse a restriction (e.g., exit windows in an external tubular and crooked holes) without diminishing the centralizer's performance (e.g., providing a desired stand-off) after running in the borehole. For example, such an assembly may include a resistance to tension and compression when the string needs to be rotated and/or moved axially, e.g., to unstick the tubular from the borehole.

A centralizer according to the disclosure herein may be used with a stop collar (such as an interference-fit, spray-metal, or molded stop collar) without negatively affecting the tubular string the stop collar and centralizer are disposed on. For example, it may be desired to not affect the axial stiffness (e.g., flexibility) of a tubular (e.g., casing string) so as not to negatively affect the running of the tubular into and/or out of the borehole. In an embodiment, a centralizer according to the disclosure herein may be used with a stop collar without additional subs or other components that add axial length to the tubular as the length of a tubular in the oilfield is generally standard, e.g., about 30 ft. Adding length to a tubular (e.g., a joint) may be undesirable, such as resulting in additional time needed to make up or break out that tubular assembly (e.g., plurality of joints threaded together). In an embodiment, a centralizer according to the disclosure herein may be used with a stop collar without negatively affecting the mechanical and pressure integrity of the tubular (e.g., tubular string). In an embodiment, a centralizer according to the disclosure herein may be used with a stop collar without reducing the wall thickness of the tubular, for example, a reduced wall thickness of a tubular created by a groove, slot or other void machined into that tubular wall may negatively affect the mechanical and/or pressure integrity of the tubular, e.g., the reduced wall thickness may form a stress concentrator.

Figure 5A:
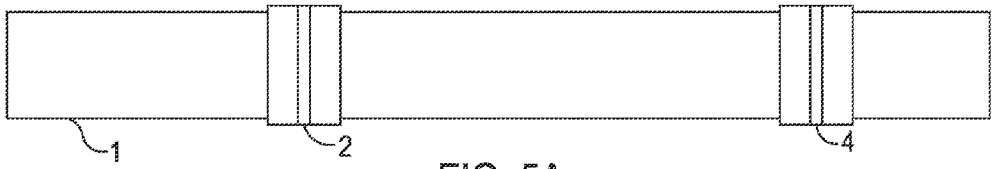
FIG. 5A illustrates a side perspective view of a tubular with two stop collars attached thereto, according to an embodiment.
Figure 5B:
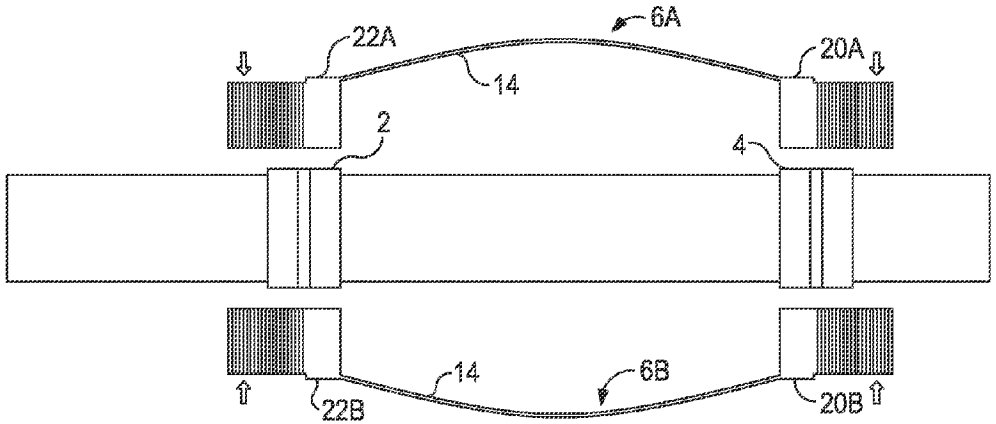
FIG. 5B illustrates a side perspective view of a split tubular body of a centralizer laterally receiving the tubular and stop collars, according to an embodiment.

FIG. 5A illustrates a perspective view of a tubular 1 with two stop collars 2, 4 attached thereto, i.e., similar to FIG. 1A, according to an embodiment. FIG. 5B illustrates a perspective view of the centralizer body 6 formed from two sections 6A, 6B being disposed on the tubular 1, over the stop collars 2, 4, according to an embodiment. Although two stop collars 2, 4 are depicted, any number of stop collars 2, 4 may be utilized. Further, the centralizer body 6 may include one or more bows 14, as described above.

The centralizer body 6 may be split into two (or more) sections 6A, 6B, as shown, but in other embodiments may include a single longitudinal split, e.g., where the tubular 1 may be laterally received into the bore defined by the body, e.g., an elastically spread apart split tubular body. The sections 6A, 6B may be formed by partially rolling and machining a flat plate, similar to the way described above. In some embodiments, the sections 6A, 6B may then be formed by cutting the plate in half, e.g., along an axially-extending line.

When split into sections 6A, 6B, the sections 6A, 6B may be identical or different in shape, material, and construction. For example, the sections 6A, 6B may form an end collar section 22A, 20A; 22B, 20B, respectively, on each end thereof, thereby forming the end collars 20, 22.

Figure 5C:
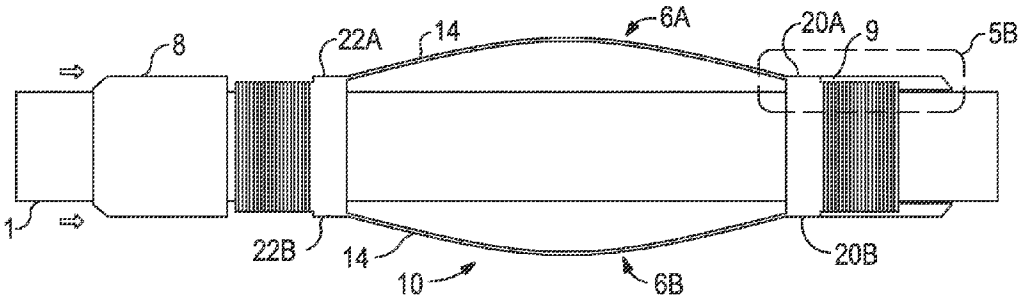
FIG. 5C illustrates a schematic view of the split tubular body of a centralizer disposed on the tubular and stop collars, according to an embodiment.

FIG. 5C illustrates a schematic side view of the centralizer 10, according to an embodiment. As shown, the centralizer 10 includes the retainer 8, which may be unitary in a circumferential direction (at least), according to an embodiment. Further, the retainer 8 may define a bore therethrough and axially disposed onto the tubular 1. The retainer 8 may include an internally-threaded portion. Further, the end collar 22 (e.g., formed by the end collar sections 22A, 22B) includes an externally thread portion. The retainer 8 may attach to the sections 6A, 6B of the centralizer 10 by threads as depicted. Additionally or alternatively, the retainer 8 may attach to the sections 6A, 6B via adhesive or welding. The retainer 8 may also or instead attach to the centralizer body 6 via a mechanical interaction or any other attachment process or device. The retainer 8 may be removably or permanently attached to the split tubular body. Further, the retainer 8 may form a shoulder therein, e.g., on an end distal the bows 14, to contact the stop collar(s) 2, 4.

The centralizer 10 may also include a second retainer 9, which may be unitary in the circumferential direction (at least). The second retainer 9 may have a bore defined therethrough, which may be attached to the sections 6A, 6B at the end collar sections (e.g., as defined by end collar sections 20A, 20B).

Figure 5D:
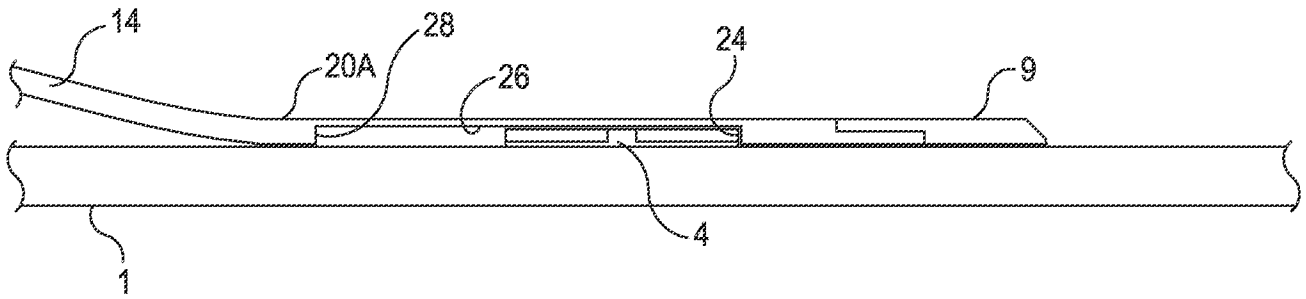
FIG. 5D illustrates an enlarged, side, schematic view of the encircled portion of FIG. 5C, according to an embodiment.

FIG. 5D illustrates an enlarged, cross-sectional, schematic view of the encircled portion of FIG. 5C, according to an embodiment. The retainer 9 may include a thinner portion for being received by a portion of the split tubular body, e.g., the end collar sections 20A, 20B making up the centralizer end collar 20 (e.g., FIG. 2A). The stop collar 4 may be received into a recess 26 (e.g., a circumferentially continuous recess) cumulatively formed by a centralizer collar, e.g., 20A, 20B. The recess 26 in FIG. 5D includes a first shoulder 28 and a second shoulder 24 therein.

The recess 26 may be axially longer than the stop collar 4 to allow axial movement of the split tubular body relative to the stop collar 4, e.g., to allow collapse of the bows. Further, the engagement between the recess 26 and the stop collar 4 may be sufficiently loose so as to allow the centralizer 10 to rotate relative to the tubular 1. The centralizer 10 may include a recess on each end thereof receiving a stop collar to allow the collars to move apart axially relative to the stop collars to allow the bows to fully collapse. In an embodiment, the centralizer collar sections are laterally disposed onto a tubular having stop collars such that a stop collar recess is received by a corresponding stop collar with a retainer then attached to the collar sections to retain the collar sections on the tubular, e.g., to retain the stop collar within a centralizer recess.

Figure 7:
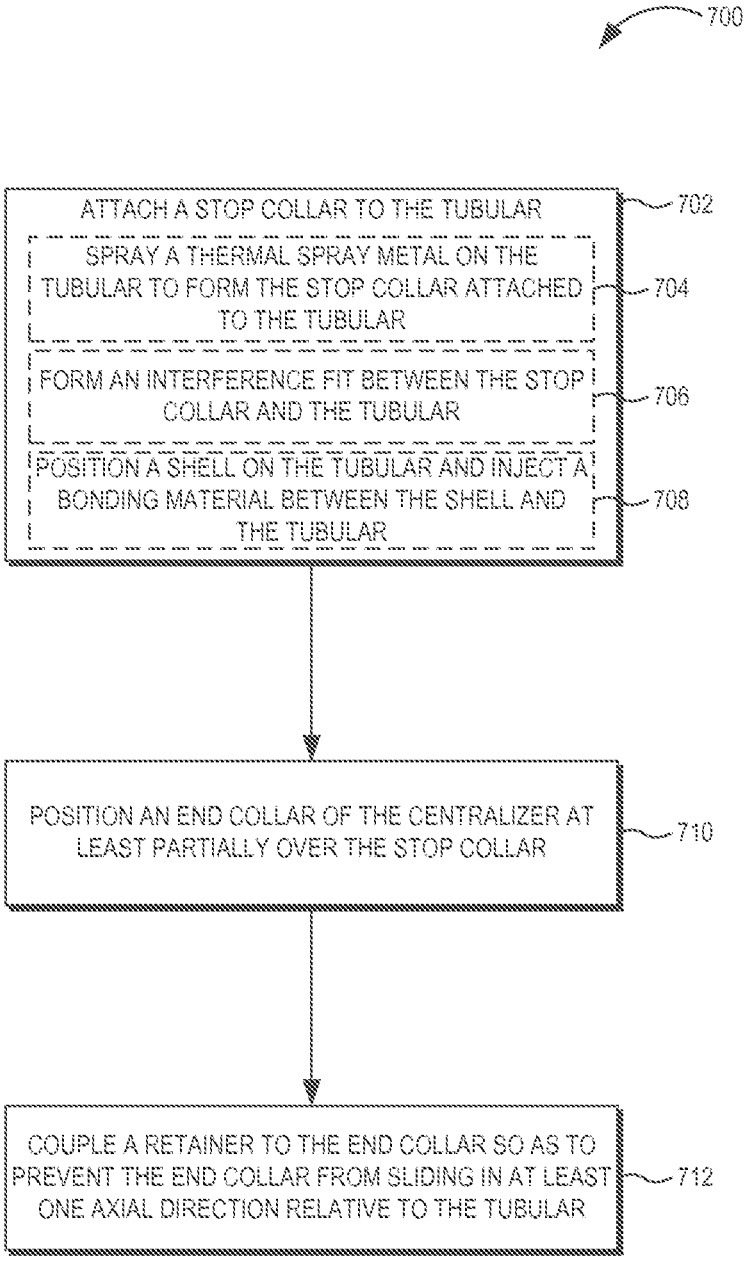
FIG. 7 illustrates a flowchart of a method for assembling a centralizer on a tubular, according to an embodiment.

FIG. 7 illustrates a flowchart of a method 700 for assembling a centralizer on a tubular, according to an embodiment. The method 700 may employ one or more embodiments of the centralizer 10 discussed above and may thus be best understood with reference thereto; however, it will be appreciated that at least some embodiments of the method 700 are not limited to any particular structure.

The method 700 may include attaching a stop collar to the tubular, as at 702. In some embodiments, attaching the stop collar includes spraying a thermal spray metal on the tubular, so as to form the stop collar in attachment with the tubular, as at 704. In some embodiments, attaching the stop collar includes forming an interference fit between the stop collar and the tubular, as at 706. Such an interference fit may be formed by expanding a sleeve over a plurality of fingers of the stop collar, such that an elasticity of the sleeve causes the sleeve to apply a radially-inward gripping force on the fingers, and thus on the tubular. In some embodiments, attaching the stop collar may include positioning a shell on the tubular and injecting a bonding material between the shell and the tubular, as at 708.

The method 700 may also include positioning an end collar of the centralizer at least partially over the stop collar, as at 710. In an embodiment, at least a portion of the end collar defines an inner diameter that is larger than an outer diameter of the stop collar.

The method 700 may further include coupling a retainer to the end collar, as at 712. In an embodiment, at least a portion of the retainer defines an inner diameter that is smaller than the outer diameter of the second stop collar, so as to prevent the end collar from sliding in at least one axial direction relative to the tubular. In an embodiment, coupling the retainer may include holding the at least two sections of the end collar together around the tubular.

In an embodiment, positioning the end collar at 710 may include sliding the end collar in a first axial direction at least partially over the stop collar. The retainer, when coupled to the end collar, may thus prevent the end collar from sliding away from the stop collar in a second axial direction that is opposite to the first axial direction. The centralizer may be free to move in a generally predetermined axial range of motion along, and free to rotate with respect to, the tubular.

In an embodiment, coupling the retainer to the end collar at 714 may include receiving at least a portion of the retainer radially between the tubular and the end collar. In another embodiment, coupling the retainer to the end collar at 714 may include receiving the retainer around an outer diameter of the end collar. In some embodiments, positioning the end collar at 714 receiving the stop collar and the tubular laterally between at least two sections of the end collar.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A centralizer, comprising:

a stop collar configured to be rotationally and axially fixed to a tubular, the stop collar defining an outer diameter;

a body comprising a first end collar and one or more centralizing ribs directly coupled with the first end collar and configured to centralize the tubular when installed thereon, wherein the first end collar has an inner diameter that is larger, along an entirety of the first end collar, than the outer diameter of the stop collar;

a retainer coupled with the first end collar and having an inner diameter that is smaller than the outer diameter of the stop collar, wherein the retainer is configured to prevent the first end collar from sliding past the stop collar in at least one axial direction; and a second stop collar configured to be positionally fixed to the tubular, the second stop collar defining an outer diameter that is smaller than the inner diameter of the first end collar.

2. The centralizer of claim 1, wherein the stop collar comprises a thermal spray metal.

3. The centralizer of claim 2, wherein the thermal spray metal extends between about 0.10 inches and about 3.00 inches radially outward from the tubular.

4. The centralizer of claim 1, wherein the stop collar comprises a shell and a bonding material configured to be disposed at least partially within the shell, to bond the shell with the tubular.

5. The centralizer of claim 4, wherein the shell defines an inlet port extending therethrough, wherein the inlet port is configured to receive the bonding material therein.

6. The centralizer of claim 1, wherein the stop collar comprises a first arcuate shell, a second arcuate shell, and a bonding material configured to be disposed at least partially between the first arcuate shell and the tubular and between the second arcuate shell and the tubular, wherein the first and second arcuate shells are circumferentially adjacent when installed on the tubular.

7. The centralizer of claim 6, wherein the first arcuate shell and the second arcuate shell each define a circumferential end, wherein the circumferential end of the first arcuate shell contacts the circumferential end of the second arcuate shell.

8. The centralizer of claim 7, wherein the first arcuate shell and second arcuate shell together extend around the tubular, when installed thereon.

9. The centralizer of claim 1, wherein the body comprises a plurality of arcuate sections, wherein, when installed on the tubular, the retainer holds the plurality of arcuate sections together around the tubular.

10. The centralizer of claim 1, further comprising a second retainer, wherein the body further comprises a second end collar spaced axially apart from the first end collar, the second retainer being coupled with the second end collar.

11. The centralizer of claim 10, wherein at least a portion of the second stop collar defines an inner diameter that is smaller than an outer diameter of at least a portion of the second stop collar, such that the second end collar is prevented from sliding past the second stop collar on the tubular.

12. A centralizer, comprising:

a stop collar configured to be rotationally and axially fixed to a tubular, the stop collar defining an outer diameter, wherein the stop collar forms an interference fit with the tubular;

a body comprising a first end collar and one or more centralizing ribs directly coupled with the first end collar and configured to centralize the tubular when installed thereon, wherein the first end collar has an inner diameter that is larger, along an entirety of the first end collar, than the outer diameter of the stop collar; and a retainer coupled with the first end collar and having an inner diameter that is smaller than the outer diameter of the stop collar, wherein the retainer is configured to prevent the first end collar from sliding past the stop collar in at least one axial direction wherein the stop collar forms an interference fit with the tubular.

13. A method for assembling a centralizer on a tubular, comprising:

attaching a stop collar to the tubular, wherein attaching comprises at least one of:

spraying a thermal spray metal on the tubular, so as to form the stop collar in attachment with the tubular;

forming an interference fit between the stop collar and the tubular; or positioning a shell on the tubular and injecting a bonding material between the shell and the tubular;

positioning an end collar of the centralizer at least partially over the stop collar, wherein the end collar defines an inner diameter along an entire axial length of the end collar that is larger than an outer diameter of the stop collar, and wherein the end collar is directly coupled to one or more centralizing ribs of the centralizer; and coupling a retainer to the end collar, wherein at least a portion of the retainer defines an inner diameter that is smaller than the outer diameter of the stop collar, so as to prevent the end collar from sliding away from the stop collar in at least one direction relative to the tubular.

14. The method of claim 13, wherein positioning the end collar comprises sliding the end collar in a first axial direction at least partially over the stop collar, and wherein the retainer, when coupled to the end collar, prevents the end collar from sliding away from the stop collar in a second axial direction that is opposite to the first axial direction.

15. The method of claim 14, wherein coupling the retainer to the end collar comprises receiving at least a portion of the retainer radially between the tubular and the end collar.

16. A method for assembling a centralizer on a tubular, comprising:

attaching a stop collar to the tubular, wherein attaching comprises at least one of:

spraying a thermal spray metal on the tubular, so as to form the stop collar in attachment with the tubular;

forming an interference fit between the stop collar and the tubular; or positioning a shell on the tubular and injecting a bonding material between the shell and the tubular;

positioning an end collar of the centralizer at least partially over the stop collar, wherein at least a portion of the end collar defines an inner diameter that is larger than an outer diameter of the stop collar; and coupling a retainer to the end collar, wherein at least a portion of the retainer defines an inner diameter that is smaller than the outer diameter of the stop collar, so as to prevent the end collar from sliding away from the stop collar in at least one direction relative to the tubular, wherein coupling the retainer to the end collar comprises receiving the retainer around an outer diameter of the end collar.

17. The method of claim 16, wherein positioning the end collar comprises receiving the stop collar and the tubular laterally between at least two sections of the end collar.

18. The method of claim 17, wherein coupling the retainer comprises holding the at least two sections of the end collar together around the tubular.

19. A centralizer assembly for connecting to a tubular, comprising:

a first stop collar fixed in place on the tubular;

a first end collar that defines an inner diameter along an entire axial length of the first end collar, the inner diameter being larger than an outer diameter of the first stop collar, such that the first end collar is sized to slide axially over the first stop collar;

a first retainer coupled with the first end collar, wherein the first retainer prevents the first end collar from sliding past the first stop collar in at least one axial direction; and a plurality of ribs directly coupled with the first end collar and configured to engage a surrounding tubular in which the tubular is disposed, wherein the first stop collar comprises:

a shell comprising a molded material and defining a cavity therein, wherein the cavity is in communication with an outer diameter of the tubular; and a bonding material received into the cavity, to hold the shell on the tubular.

* * * * *